US007043826B2

(12) United States Patent
Naito

(10) Patent No.: US 7,043,826 B2
(45) Date of Patent: May 16, 2006

(54) APPARATUS FOR CORRECTING SETTING OF SELF-PIERCING RIVETS, FOR REMOVING SELF-PIERCING RIVETS, AND FOR SETTING SOLID RIVETS

(75) Inventor: Nobuharu Naito, Toyohashi (JP)

(73) Assignee: Newfrey LLC, Newark, DE (US)

( * ) Notice: Subject to any disclaimer, the term of this patent is extended or adjusted under 35 U.S.C. 154(b) by 98 days.

(21) Appl. No.: 10/852,149

(22) Filed: May 25, 2004

(65) Prior Publication Data

US 2004/0261259 A1 Dec. 30, 2004

(30) Foreign Application Priority Data

Jun. 5, 2003 (JP) ..... 2003-160438

(51) Int. Cl.
*B23P 19/00* (2006.01)

(52) U.S. Cl. ..... 29/798; 29/252; 29/255; 29/426.5

(58) Field of Classification Search ..... 29/402.03, 29/402.05, 402.06, 402.08, 525.06, 243.53, 29/243.54, 254, 255, 426.4, 426.5, 716, 798, 29/252
See application file for complete search history.

(56) References Cited

U.S. PATENT DOCUMENTS

| | | | | | |
|---|---|---|---|---|---|
| 2,407,904 | A * | 9/1946 | Rosan | 29/402.08 |
| 3,576,064 | A * | 4/1971 | Brackin | 29/254 |
| 3,947,945 | A * | 4/1976 | Gulistan | 29/235 |
| 3,973,317 | A * | 8/1976 | Gulistan | 29/426.5 |
| 4,365,401 | A | 12/1982 | Ogren | 29/243.53 |
| 4,476,615 | A * | 10/1984 | Cook | 29/243.54 |
| 4,602,414 | A * | 7/1986 | Bartholomew et al. | 29/243.54 |
| 4,637,113 | A * | 1/1987 | Cook | 29/243.54 |
| 4,918,798 | A * | 4/1990 | Reed | 29/243.54 |
| 4,949,446 | A * | 8/1990 | Kuwica | 29/243.53 |
| 5,259,104 | A * | 11/1993 | Givler | 29/426.5 |
| 5,438,743 | A * | 8/1995 | Simington et al. | 29/275 |
| 5,531,009 | A * | 7/1996 | Givler | 29/243.53 |
| 5,579,567 | A * | 12/1996 | Acevedo | 29/275 |
| 5,694,672 | A * | 12/1997 | Perin | 29/426.5 |
| 5,722,144 | A | 3/1998 | Bora | 29/402.05 |
| 5,850,679 | A * | 12/1998 | Hoffman | 29/252 |
| 6,106,446 | A * | 8/2000 | Kelly et al. | 483/28 |
| 6,108,890 | A * | 8/2000 | Opper et al. | 29/426.5 |
| 6,135,933 | A * | 10/2000 | Kelly et al. | 483/28 |
| 6,240,614 | B1 * | 6/2001 | Kojima et al. | 29/426.4 |
| 6,330,738 | B1 * | 12/2001 | Yoshikawa et al. | 29/426.4 |
| 6,332,259 | B1 * | 12/2001 | Yoshikawa et al. | 29/407.01 |
| 6,412,158 | B1 * | 7/2002 | Moore | 29/249 |
| 6,654,997 | B1 * | 12/2003 | Donovan et al. | 29/426.4 |
| 6,964,094 | B1 * | 11/2005 | Kondo | 29/798 |
| 2005/0028343 | A1 * | 2/2005 | Rousset | 29/428 |
| 2005/0044684 | A1 * | 3/2005 | Haines | 29/426.4 |
| 2005/0050706 | A1 * | 3/2005 | Motzno | 29/426.5 |
| 2005/0081354 | A1 * | 4/2005 | Motzno et al. | 29/402.12 |

FOREIGN PATENT DOCUMENTS

| | | |
|---|---|---|
| JP | 62-6943 | 1/1987 |
| JP | 5-93639 | 12/1993 |

* cited by examiner

*Primary Examiner*—Essama Omgba
(74) *Attorney, Agent, or Firm*—Miles & Stockbridge P.C.

(57) ABSTRACT

A hand-held power performs three operations, selectively. A first operation corrects the setting of an improperly set self-piercing rivet. A second operation removes a self-piercing rivet from workpieces. A third operation sets a solid rivet, which may replace a removed self-piercing rivet. For performing these operations, three interchangeable sets of components are provided.

5 Claims, 5 Drawing Sheets

APPARATUS FOR CORRECTING SETTING OF SELF-PIERCING RIVETS, FOR REMOVING SELF-PIERCING RIVETS, AND FOR SETTING SOLID RIVETS

CROSS-REFERENCE TO RELATED APPLICATION

This application claims the benefit of Japanese patent application No. 2003-160438 filed Jun. 5, 2003, incorporated herein by reference.

BACKGROUND OF THE INVENTION

The present invention is concerned with an apparatus capable of selectively performing several operations relating to rivets, more particularly, a first operation in which improper setting of a self-piercing rivet is corrected, a second operation in which a self-piercing rivet is removed from workpieces, and a third operation in which a solid rivet is set, in place of a removed self-piercing rivet, for example.

A self-piercing rivet comprises a large-diameter head and a hollow shaft extending from the head. Riveting apparatus for joining workpieces by means of self-piercing rivets includes a punch and a cooperable die. The punch engages the head of the rivet and presses the shaft of the rivet through workpieces toward the die, which spreads the shaft to set the rivet.

Self-piercing rivets are used in the automotive industry, for example, to join pieces of sheet material. When properly set, the head of a rivet is pressed into a first workpiece, almost flush with a surface thereof, and leg portions of the shaft of the rivet pierce a second workpiece and are spread apart while remaining therein. Because no rivet penetration hole is formed in an exposed surface of the latter workpiece, there is no appearance impairment and no opening through which water or sound, for example, can penetrate.

There are occasions in which a self-piercing rivet is improperly set and in which it is desired to correct the setting. There are other occasions in which it is desired to remove a self-piercing rivet and to replace it with a solid rivet. There are prior art apparatuses for performing some of these functions, but not for performing all of these functions conveniently in a single apparatus. See, for example, Laid-open Utility Model Application No. S62-6943/1987 Gazette (Published Utility Model No. H3-31466/1991 Gazette) and Laid-open Utility Model Application No. H5-93639/1993 Gazette (Published Utility Model No. H7-47161/1995 Gazette) disclosing tools for removing solid rivets set in workpieces; U.S. Pat. No. 4,365,401 disclosing a tool capable of removing solid rivets set in workpieces, and also capable of setting solid rivets in workpieces; and Published Japanese Translation of Patent, No. H9-500059/1997 Gazette (corresponding to U.S. Pat. No. 5,722,144) disclosing a tool capable of removing self-piercing rivets set in workpieces and also capable of setting solid rivets in workpieces after self-piercing rivets have been removed.

BRIEF DESCRIPTION OF THE INVENTION

The present invention provides a simple apparatus capable, selectively, of correcting the setting of an improperly set self-piercing rivet, of removing a set self-piercing rivet, and of setting a solid rivet in place of a removed self-piercing rivet.

In a preferred embodiment, an apparatus for use in correcting the setting of self-piercing rivets improperly set in workpieces, for use in removing self-piercing rivets from workpieces, and for use in setting solid rivets in workpieces, comprises a frame having a pair of arms with portions spaced apart to provide a gap for receiving workpieces between opposed positions of the arms, a die support at one of said positions and a punch support at the other of said positions, the punch support being reciprocative with respect to the die support, and three exchangeable sets of punch-and-die components, each set having components constructed for mounting at said die support and at said punch support, respectively, wherein a first of said sets of components is constructed to correct the setting of an improperly set self-piercing rivet, a second of said sets of said components is constructed to remove a set self-piercing rivet, and a third of said sets of components is constructed to set a solid rivet.

BRIEF DESCRIPTION OF THE DRAWINGS

The invention will be further described in conjunction with the accompanying drawings, which illustrate a preferred (best mode) embodiment of the invention, and wherein.

DETAILED DESCRIPTION OF THE INVENTION

Figure 1:
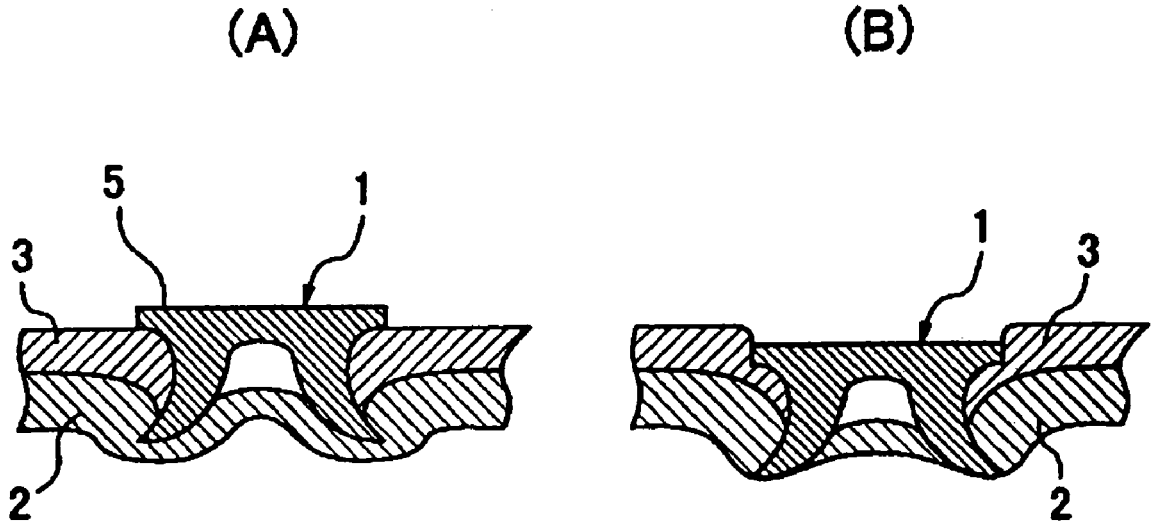
FIG. 1(A) is a sectional view showing a self-piercing rivet that has been insufficiently pressed into workpieces.
FIG. 1(B) is a sectional view showing a self-piercing rivet that has been excessively pressed into workpieces.

As mentioned earlier, there are occurrences in which a self-piercing rivet has been improperly set. For example, as shown in FIG. 1(A), the head 5 of a rivet 1 has not been sufficiently pressed into a workpiece 3 to be joined to a workpiece 2, and in FIG. 1(B), a rivet has been excessively pressed into the workpieces. As later described, the rivet 1 shown in FIG. 1(A) can be re-set by apparatus of the invention by pressing the rivet further into the workpieces. In the occurrence shown in FIG. 1(B), the apparatus of the invention can be used to expel the rivet from the workpieces, as later described. A further example of improper setting of a self-piercing rivet involves a rivet that becomes tilted when it is pressed into workpieces. Using the invention, it may be possible to correct such improper setting by resetting the rivet, but if necessary, the rivet can be expelled from the workpieces.

Figure 2:
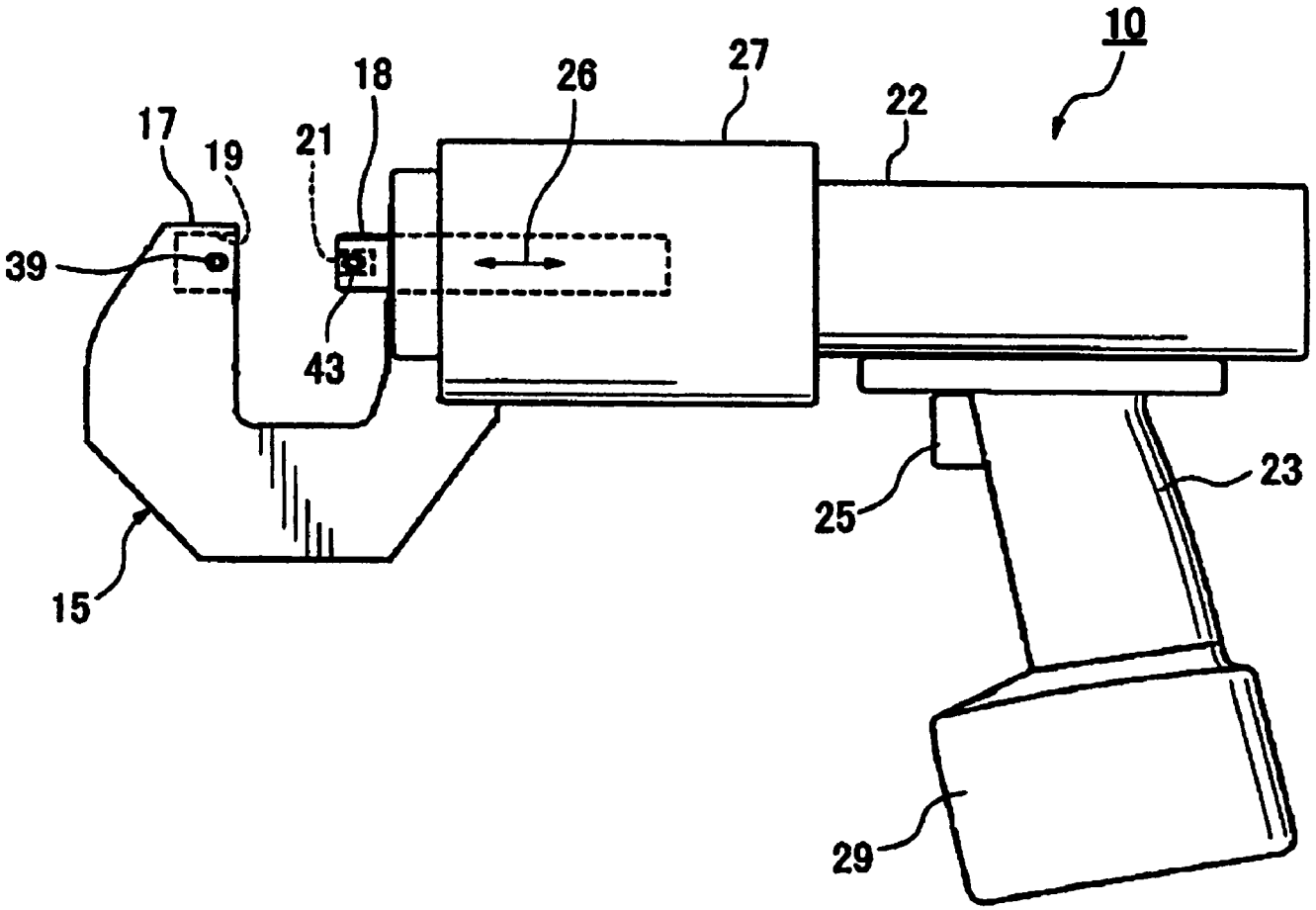
FIG. 2 is a side elevation view of a hand-held power tool utilizing the invention.

FIG. 2 shows a hand-held power tool 10 for performing various operations in accordance with the invention. In the form shown, the tool comprises a C-frame 15 having a pair of arms with portions spaced apart to provide a gap for receiving workpieces between opposed positions near the tips of the arms. One of these positions has a die support 17, and the other has a punch support 18 which can be reciprocated with respect to the die support 17 as indicated by arrow 26. The die support 17 has a hole 19 (preferably cylindrical) for accommodating and holding a die. The punch support 18 comprises a rod the tip of which has a hole 21 (preferably cylindrical) for accommodating and holding a punch.

The tool 10 has a body or housing 22 with a motor 27 for moving the punch support 18 reciprocatively with respect to the die support 19. The motor may be an electric motor powered by a battery 29 (preferably rechargeable). The electric motor may be a linear motor or a rotary motor provided with a mechanism for converting rotary motion to linear motion. Instead of the battery 29, a power cord may be provided for supplying the motor from an electrical outlet.

Instead of an electric motor and battery, the motor may comprise an air pressure piston/cylinder device supplied with compressed air from a remote air compressor (not shown). A hydraulic motor with a piston/cylinder device may also be used, with hydraulic fluid being supplied from an internal or external pump, for example. The power tool 10 has a handle 23, by which an operator holds the tool, and the handle has a trigger 25 for controlling the actuation of the motor, which drives the punch support 18 in a conventional manner. Various conventional devices (not shown) may be provided for selecting movement of the punch support 18 toward or away from the die support 17, or the drive mechanism which moves the punch support 18 may be designed to advance the punch support toward the die support when the trigger 25 is pressed and to retract the punch support to its original rest position when the trigger 25 is released.

Figure 3:
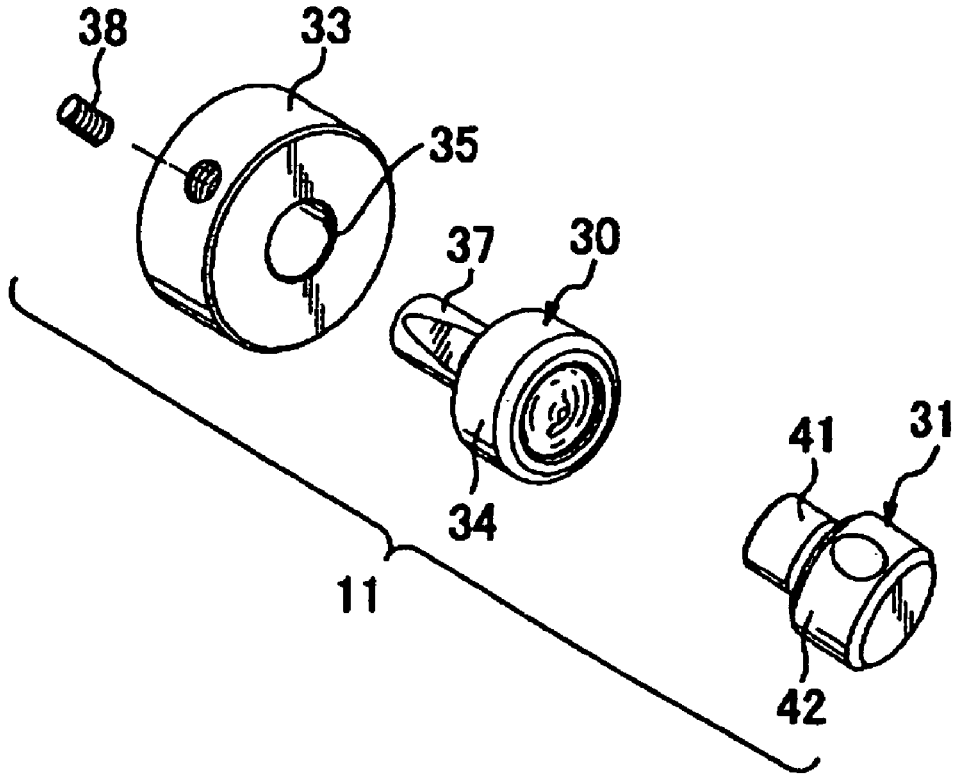
FIGS. 3–5 are perspective views of sets of components used with a tool of FIG. 2, for example, to perform different operations with regard to rivets.
Figure 4:
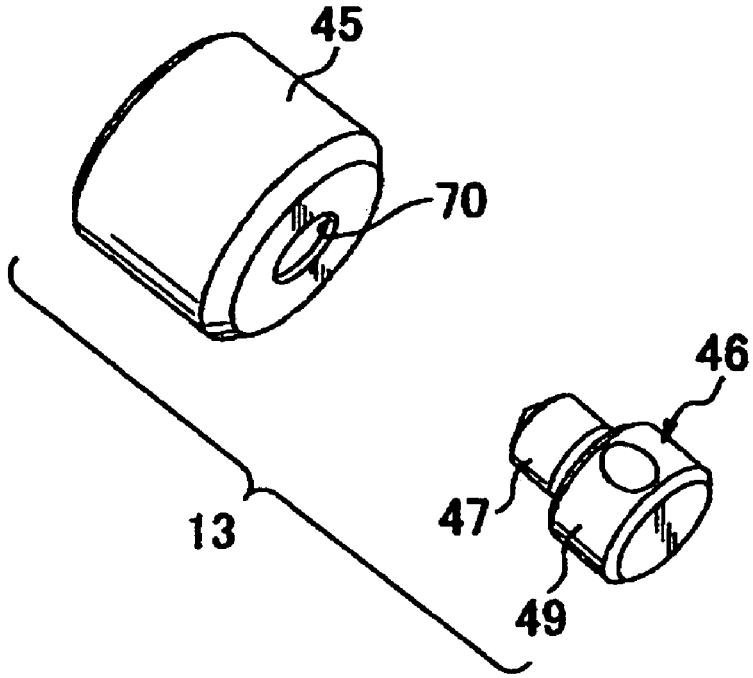
Figure 5:
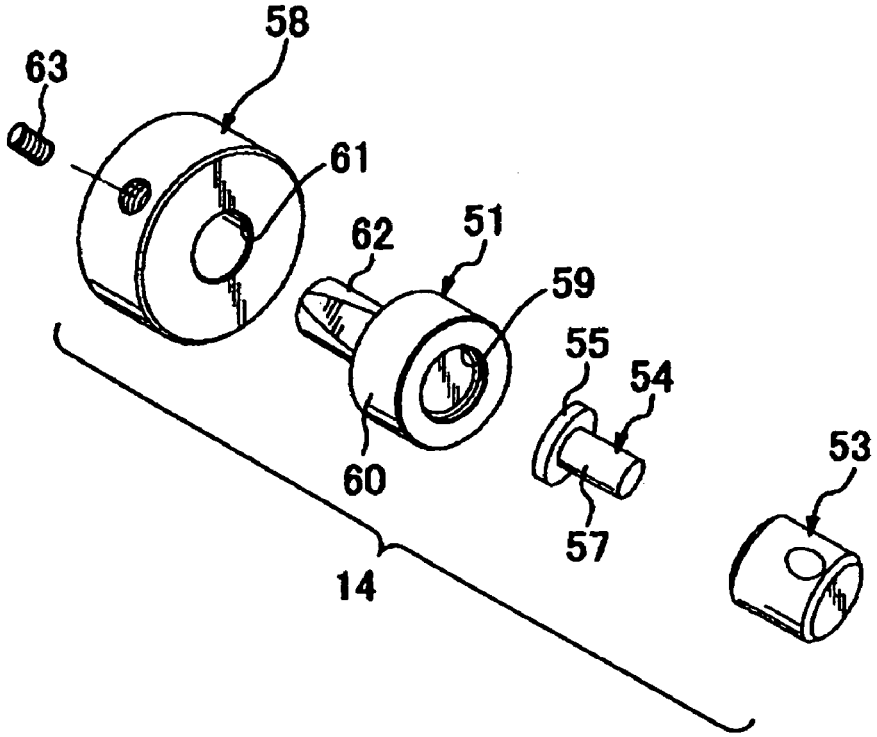

FIGS. 3–5 show interchangeable sets of components used in the performance of different operations relating to riveting.

FIG. 3 shows a set of components 11 used for resetting an improperly set self-piercing rivet. These components include a cylindrical die base 33 which fits in the die receiving hole 19 of the die support 17, a die 30 comprising a cylindrical main die portion 34 having a shaft 37 the diameter of which matches a support hole 35 formed in the die base 33, and a punch 31 with a head 41 and a cylindrical base 42 which fits in the punch receiving hole 21 of the punch support 18. The base 42 is detachably secured in the punch receiving hole 21 by a set screw 43 as shown in FIG. 2. The die 30 can be selected from among the different types of dies currently used for setting self-piercing rivets, depending on the size of the rivet, for example, and can be detachably secured in the die base 33 by means of a set screw 38 threaded into the die base and engaging the shaft 37. The die base 33 is detachably secured in the die receiving hole 19 by a set screw 39 as shown in FIG. 2.

FIG. 4 shows a set of components 13 used in removing (punching out) a self-piercing rivet from workpieces. These components include a cylindrical punching out die 45 detachably secured to the die support 17 as disclosed with regard to die base 33 of FIG. 3, and a punch 46 detachably secured to the punch support 18 as disclosed with regard to the punch 31 of FIG. 3. The punch 46 has a head 47 and a base 49. The die 45 has a passage 70 through which a rivet can be expelled by the punch 46.

FIG. 5 shows a set of components 14 used for setting a solid rivet 54 having a head 55 and a solid shaft 57. These components include a die base 58 detachably secured in the die receiving hole 19 by set screw 39 (like die base 33) with a hole 61 for receiving a shaft 62 extending from a main die portion 60 of a die 51, and detachably secured in hole 61 by a set screw 63. The main die portion 60 has a concavity 59 for receiving the head 55 of the rivet 54 A punch 53 is detachably secured in the punch receiving hole 21 by the set screw 43.

Figure 6:
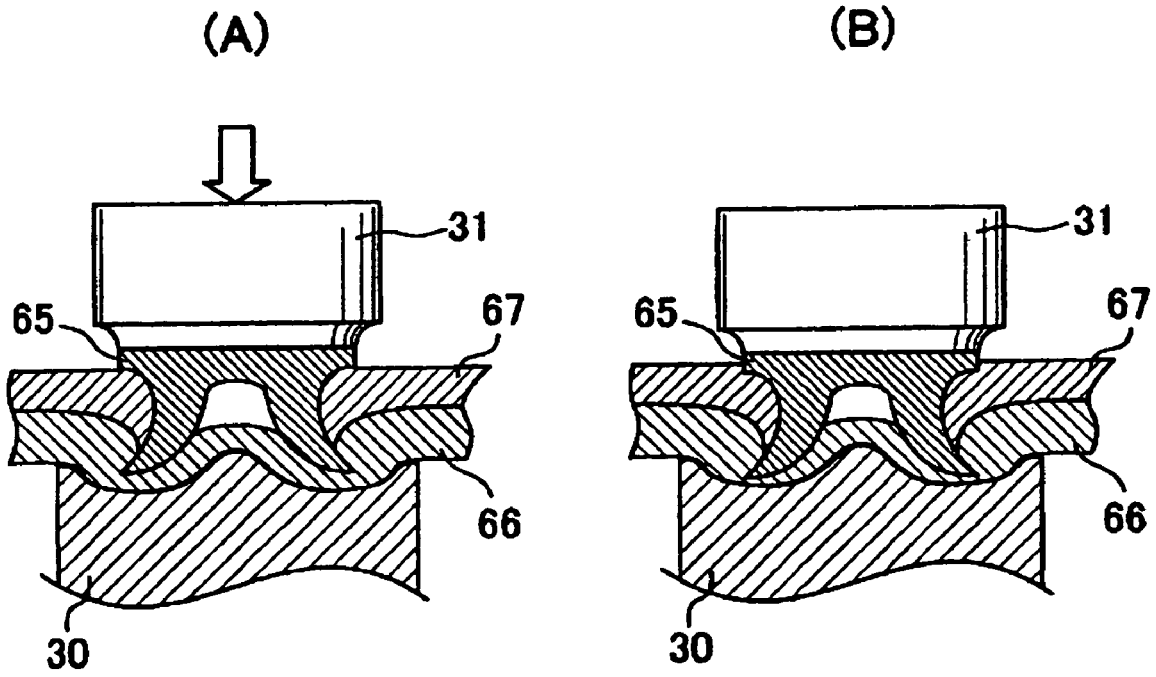
FIGS. 6(A) and 6(B) are sectional views showing use of apparatus in accordance with the invention for correcting the setting of an improperly set self-piercing rivet.

FIGS. 6(A) and 6(B) show an operation in which the punch 31 and die 30 of FIG. 3 are used to correct the setting of an improperly set self-piercing rivet 65. To perform this operation, the components 11 are mounted on the tool 10 in the manner previously described, and the workpieces 66 and 67 are placed in the gap between the arms of the C-frame 15 with the rivet 65 aligned with the die 30 and the punch 31. Then, as shown in FIG. 6(A), when the trigger 25 is pressed to advance the punch toward the die, the punch 31 presses on the head of the rivet 65, which has been insufficiently set into the workpiece 67, to reset the rivet as shown in FIG. 6(B) for properly joining the workpieces 66 and 67.

Figure 7:
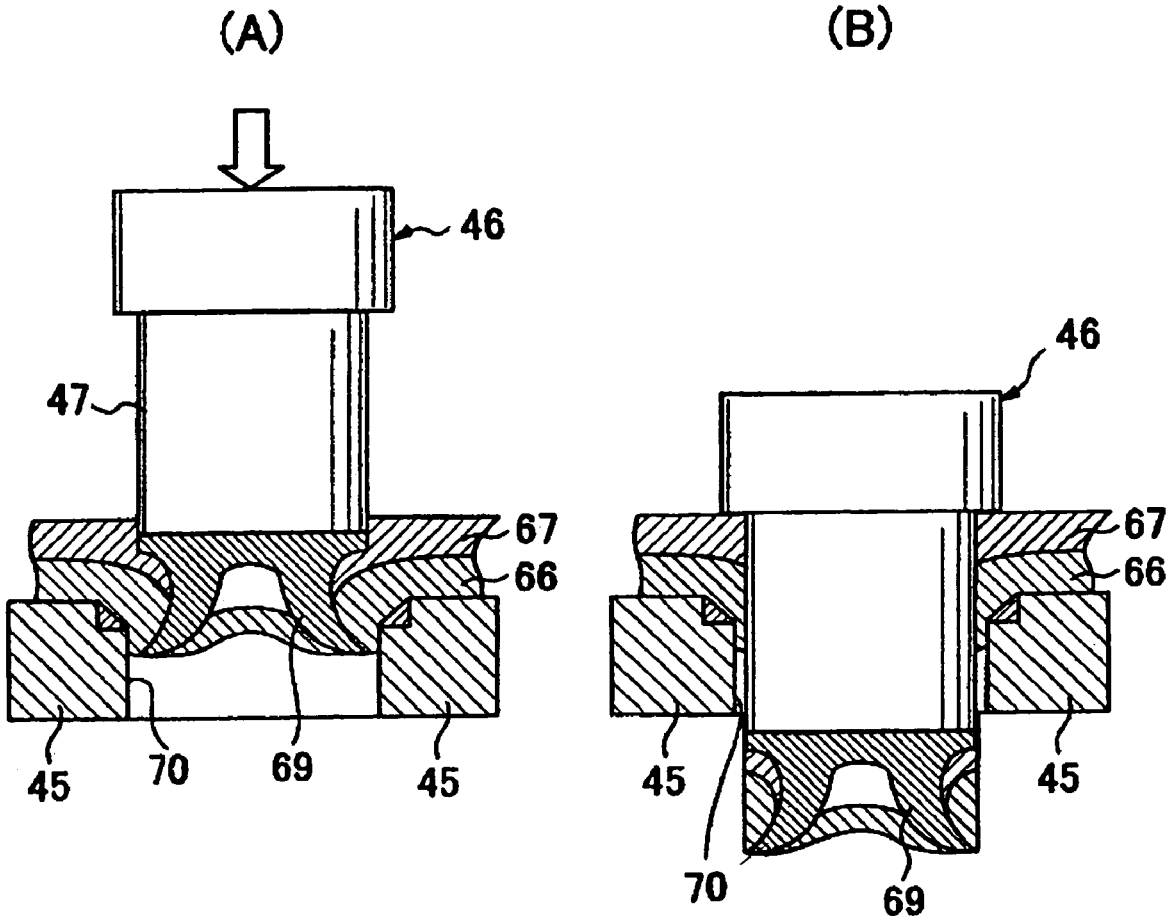
FIGS. 7(A) and 7(B) are sectional views showing use of apparatus in accordance with the invention for removing a self-piercing rivet from workpieces.

FIGS. 7(A) and 7(B) show an operation in which a self-piercing rivet is removed from workpieces 66 and 67 by the apparatus of the invention. To perform this operation, the punch 46 and the die 45 are mounted on the arms of the C-frame 15, as previously described, and the workpieces 66 and 67 are placed in the gap between the arms with the rivet 69 aligned between the punch and the die. In the example shown, the self-piercing rivet 69 has been excessively pressed into the workpieces. To remove the rivet 69 from the workpieces, the trigger 25 of the tool 10 is pressed to engage the head 47 of the punch with the head of the rivet 69, as shown in FIG. 7(A), and the punch is advanced into the hole 70 of the die 45 to expel the rivet from the workpieces. As shown in FIG. 7(B), the diameter of the head 47 of the punch is substantially the same as the diameter of the head of the rivet 69 but is slightly smaller than the diameter of the hole 70.

Figure 8:
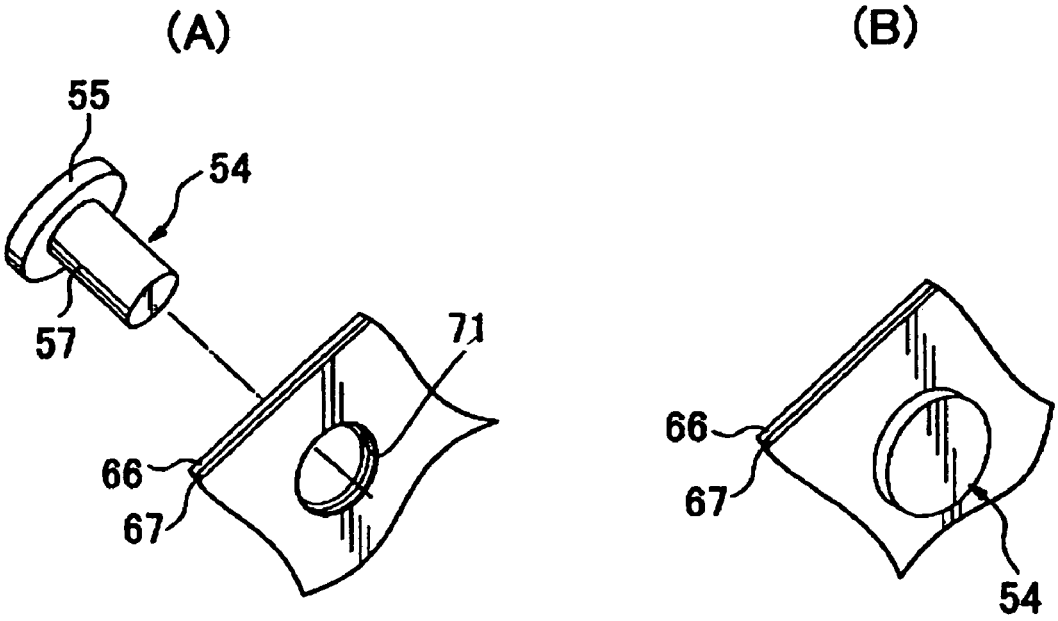
FIGS. 8(A) and 8(B) are perspective views showing the setting of a solid rivet in workpieces.

FIGS. 8(A) and 8(B) show an operation in which a solid rivet 54 is set in workpieces 66 and 67 having a hole 71 formed by the punch 46 during expulsion of a self-piercing rivet. To perform this operation, the components 14 shown in FIG. 5 are mounted on the arms of the C-frame 15, with the head 55 of the rivet 44 received in the concavity 59 of the die 51, and the workpieces 66 and 67 are placed in the gap between the arms, with the hole 71 receiving the shaft 57 of the rivet 54. When the trigger 25 is pressed to advance the punch 53 toward the die, the end of the solid shaft 54 of the rivet is flattened and expanded as shown in FIG. 8(B).

While a preferred embodiment of the invention has been shown and described, it will be apparent that changes can be made without departing from the principles and the spirit of the invention, the scope of which is defined in the accompanying claims. For example, the invention may be used in clinching.

What is claimed is:

1. An apparatus for use in correcting the setting of self-piercing rivets improperly set in workpieces, for use in removing self-piercing rivets from workpieces, and for use in setting solid rivets in workpieces, comprising:

a frame having a pair of arms with portions spaced apart to provide a gap for receiving workpieces between opposed positions of the arms;

a die support at one of said positions and a punch support at the other of said positions, the punch support being reciprocative with respect to the die support; and three interchangeable sets of punch-and-die components, each set having components constructed for detachable mounting on said die support and on said punch support, respectively, wherein a first of said sets of components is constructed to correct the setting of an improperly set self-piercing rivet, a second of said sets of said components is constructed to remove a set self-piercing rivet, and a third of said sets of components is constructed to set a solid rivet.

2. The apparatus according to claim 1, wherein each of the first and third sets of components includes a punch constructed to fit in a hole in the punch support, a base constructed to fit in a hole in the die support, and a die constructed to fit in a hole in the base, and wherein the second set of components includes a punch constructed to fit in the hole in the punch support and a die constructed to fit in the hole in the die support, and having a passage through which a self-piercing rivet can be expelled by the punch.

3. The apparatus according to claim 2, wherein the dies of the first and third sets are detachable from the corresponding bases.

4. The apparatus according to claim 1, wherein the frame is a C-frame having said arms.

5. The apparatus according to claim 4, wherein the apparatus is a hand-held power tool having a body supporting the C-frame and a motor for moving the punch support, and having a handle attached to the body and a trigger on the handle for operating the motor.

* * * * *